US009643699B2

(12) United States Patent
Jeannin et al.

(10) Patent No.: US 9,643,699 B2
(45) Date of Patent: May 9, 2017

(54) SYSTEM AND METHOD FOR PUTTING ON HOLD BOATS AFLOAT ON A WATER BODY AFTER THEY ARE LAUNCHED AND/OR BEFORE THEY ARE HAULED OUT

(71) Applicant: Savoye, Dijon (FR)

(72) Inventors: Remy Jeannin, Fixin (FR); Jean-Michel Strauss, Dijon (FR)

(73) Assignee: SAVOYE, Dijon (FR)

( * ) Notice: Subject to any disclaimer, the term of this patent is extended or adjusted under 35 U.S.C. 154(b) by 0 days.

(21) Appl. No.: 14/808,764

(22) Filed: Jul. 24, 2015

(65) Prior Publication Data

US 2016/0023730 A1 Jan. 28, 2016

(30) Foreign Application Priority Data

Jul. 24, 2014 (FR) ..... 14 57175
Jul. 25, 2014 (FR) ..... 14 57241

(51) Int. Cl.
*B63B 21/00* (2006.01)
*B63C 1/02* (2006.01)
(Continued)

(52) U.S. Cl.
CPC ..... *B63C 1/02* (2013.01); *B63B 27/14* (2013.01); *B63C 1/04* (2013.01); *B63C 3/10* (2013.01); *B63C 15/00* (2013.01)

(58) Field of Classification Search
CPC ..... B63B 27/00; B63B 27/02; B63B 27/18; B63B 27/14; B63B 27/30; B63B 27/32;
(Continued)

(56) References Cited

U.S. PATENT DOCUMENTS 3,189,198 A * 6/1965 Filak ..... B63C 15/00 108/109
3,372,817 A * 3/1968 Conklin ..... B63C 15/00 414/239

(Continued)

FOREIGN PATENT DOCUMENTS

JP 01129369 A 5/1989
JP 04166493 A 6/1992
WO 2009097342 A2 8/2009

OTHER PUBLICATIONS

English translation of the French Written Opinion dated Feb. 26, 2015 for corresponding French Patent Application No. FR 1457241, filed Jul. 25, 2014.
French Search Report and Written Opinion dated Feb. 26, 2015 for corresponding French Patent Application No. FR 1457241, filed Jul. 25, 2014.

*Primary Examiner* — Daniel V Venne
(74) *Attorney, Agent, or Firm* — David D. Brush; Westman, Champlin & Koehler, P.A.

(57) ABSTRACT

A system is proposed for putting boats on hold when they are afloat on a water body after they have been launched and/or before they are hauled out of the water. The system for putting on hold includes: a floating device, having a central floating element and secondary elements extending from the central floating element. Each secondary element being associated with a reception place and having at least one point for driving, by thrust or traction, a boat positioned in an associated reception place. A system for moving is adapted to moving the secondary elements around the central floating element and, via the points for driving, moving the boats that are positioned in the reception places.

17 Claims, 5 Drawing Sheets

Figure 1:
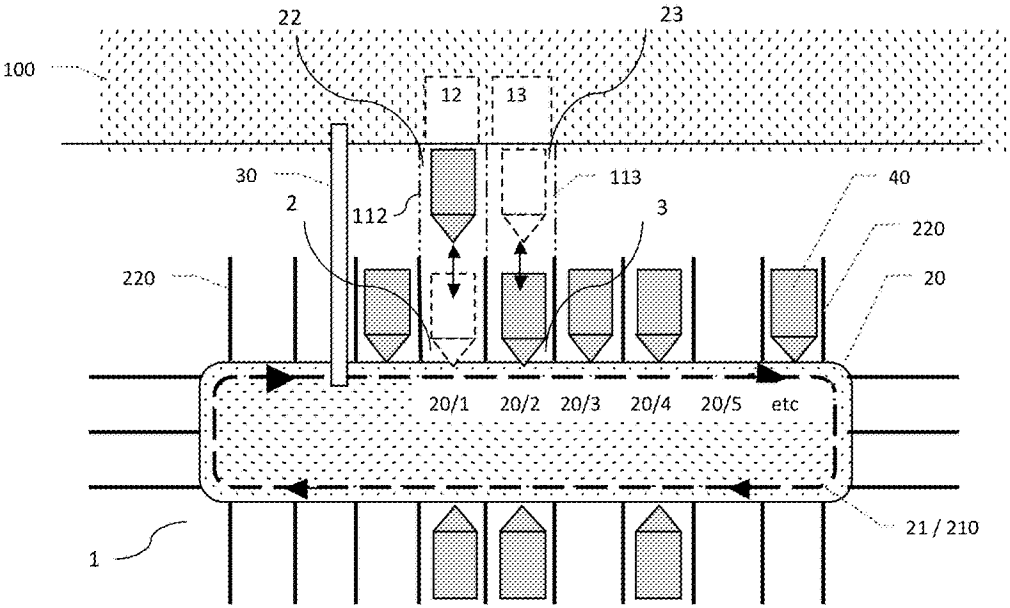

(51) Int. Cl.

| | |
|---|---|
| ***B63C 1/04*** | (2006.01) |
| ***B63C 15/00*** | (2006.01) |
| ***B63B 27/14*** | (2006.01) |
| ***B63C 3/10*** | (2006.01) |

(58) Field of Classification Search
CPC . B63B 27/36; B63B 2027/00; B63B 2027/02; B63B 2027/14; B63C 1/02; B63C 3/10
USPC ... 114/230.1, 230.12, 230.15, 230.2, 230.23, 114/230.25, 230.26, 231
See application file for complete search history.

(56) References Cited

U.S. PATENT DOCUMENTS

| | | | | | |
|---|---|---|---|---|---|
| 4,070,979 | A * | 1/1978 | Otis | B63C 3/06 | 114/263 |
| 4,190,013 | A * | 2/1980 | Otis | B63C 3/06 | 114/263 |
| 4,640,214 | A * | 2/1987 | Bruns | B63B 35/44 | 114/258 |
| 4,726,316 | A * | 2/1988 | Bruns | B63B 35/44 | 114/125 |
| 6,007,288 | A * | 12/1999 | Maffett | B63C 15/00 | 414/254 |
| 2002/0176767 | A1 * | 11/2002 | Gisselberg | B63C 3/06 | 414/261 |

* cited by examiner

SYSTEM AND METHOD FOR PUTTING ON HOLD BOATS AFLOAT ON A WATER BODY AFTER THEY ARE LAUNCHED AND/OR BEFORE THEY ARE HAULED OUT

1. FIELD OF THE INVENTION

The field of the invention is that of pleasure boating or recreational boating and the storage or parking of boats.

More specifically, the invention relates to a system for putting on hold boats afloat on a water body after they have been launched and/or before they are hauled out.

The invention is not limited to one particular type of water body, and can therefore be applied both to a marine water body (on the coast) and to an inland water body, on the edge of an estuary, or to inland waterways (streams, rivers, canals, lakes, etc.).

The present invention can be applied especially but not exclusively when a system for storing boats on land (dry docks or boat parks) is implemented, and when the question therefore arises of putting boats on hold when afloat, on the one hand after they are launched by the land storage system and, on the other, before they are hauled out of water towards a land storage system.

The present invention can be combined with a traditional system of storage.

More generally, it can be applied in all cases where the question arises of putting boats on hold when afloat, after they have been launched and/or before they are hauled out of water, and therefore it can be applied whatever the type of launching and hauling-out station, i.e. whatever the way in which the boats are handled (on land) until they reach the launching position or starting from the hauling-out position (with or without land storage systems, of the dry dock or boat park type).

2. TECHNOLOGICAL BACKGROUND

For several years now, there has been a need for new parking places for pleasure boats or recreational boats. In the face of the unsatisfied demand for places in harbors, interest has been focused on solutions for storing boats on land, as alternative solutions complementary to floating ports, especially for the storage of small boats.

In general, there are two large classes of solutions for storing boats on land: dry docks and boat parks.

Dry docks offer pleasure-boat owners a service of storage on land and of launching of the boats when they request it, the operations being performed professionally, using specific, speedy and high-performance handling equipment (wharf fork-lift trucks, self-propelling hydraulic dolly on ramp, dock basin lift, cranes or mechanical boat lifts with removal on transporter trucks, systems with travelling cranes or carrier units, etc.). The boats are parked horizontally (for example on an open area (platform) or vertically (in metal structures in the form of racks on several levels ("boat racks"), outdoors or in shelters).

Boat parks are terrestrial spaces allocated permanently or seasonally to the parking of small boats launched by light handling means (tugs or trucks) most usually by the user himself, if the launching is done by using a ramp, or by means of heavier handling machines (jib cranes, power lift trucks or boat lifts) available on self-service or handled by the park manager if the launching is done from a wharf or quay.

We shall strive more particularly here below in the document to describe the problems and issues that the inventors of the present patent application have confronted and that exist when a dry dock type storage system for storing boats on land is implemented. As already mentioned further above, the invention is naturally not limited to this particular context of application but is of value in all cases where boats afloat have to be put on hold after they have been launched and/or before they are hauled out of water.

In a dry dock, a holding area for boats while afloat must imperatively be planned in proximity to the handling wharf (the wharf in which the handling machines used for launching boats or hauling them out of water are placed).

This place for keeping boats on hold when afloat has two symmetrical functions for the dry dock operator:

- placing boats afloat on hold after they have been launched (i.e. the function of being able to launch boats in advance and keep them available for the pleasure-boat owners); and
- placing boats afloat on hold before they are hauled out of the water (i.e. the function of making it possible to park the boats when they return and organizing the queue for the handling operations performed to return them to dry docks).

In other words, the area for keeping boats on hold when afloat is aimed at reducing the bottlenecks constituted by the launching/hauling-out stations for boats and therefore at minimizing the waiting time of the pleasure-boat owners and meeting demand and the requirements of busy periods as efficiently as possible. It also enables secure removal or return of boats that is independent of the handling and storage areas.

Classically, the holding area comprises a holding wharf or a holding pontoon or floating dock. Its size depends for example on the capacity of the dry dock, the rate at which the boats exit during peak times and the speed of the handling operations.

The presently used technique for placing boats on hold (the holding wharf or holding pontoon) is not optimal and has several drawbacks, especially:

- the capacity of putting boats on hold (i.e. the number of boats that can be put on hold) is limited, unless the length of the holding wharf or the holding pontoon is increased, which is not desirable since this amounts to increasing the occupancy of the seafront (i.e. more generally restricting the possibilities of access to the water body as defined here above);
- at peak hours, the user must wait for the boat to be made available and for it to be taken into account for storage;
- the action by the pleasure-boat owner and/or the staff of the port is necessary during operations for moving the boat to or from the holding area: on the one hand after the boat has been launched to bring it from a launching position to a receiving position in the holding area and to moor it and on the other hand before the boat been hauled out of the water to unmoor it and bring it to a reception place in the holding area up to a hauling-out position;
- there is a need to secure the boats during these operations for moving the boat to or from the holding area as well as during periods of being on hold when afloat, in the waiting area.

3. SUMMARY OF THE INVENTION

One particular embodiment of the invention proposes a system for putting boats on hold when they are afloat on a water body after they have been launched and/or before they are hauled out of the water, this system comprising:

a floating device, comprising a central floating element and secondary elements extending from the central floating element, each secondary element being associated with a reception place and comprising at least one point for driving, by thrust or traction, a boat positioned in said associated reception place; and a first system for moving, adapted to moving the secondary elements around the central floating element and, via the points for driving, moving the boats that are positioned in the reception places.

Thus, this particular embodiment of the invention relies on a wholly novel and inventive approach consisting in making a "floating carousel for boats" in making the reception places and the boats that are positioned therein rotate about a central floating element. This increases the capacity for the putting boats on hold without restricting the possibilities of access to the water body. This also fulfills a buffer function to program the operations for making available, thus very significantly reducing the waiting time for pleasure-boat owners. The waiting time is also reduced when the boat is returned.

According to one particular characteristic, the first system for moving is adapted to moving the secondary elements in a closed-loop trajectory around the central floating element.

In this way, the first system for moving is simplified.

According to one particular characteristic, the system for putting on hold comprises at least one passageway connecting the central floating element to a wharf or to a bank of the water body.

In this way, the pleasure-boat owners can easily access boats situated in the reception places.

According to one particular characteristic, the first system for moving is adapted to moving of the secondary elements at a speed of 1 to 25 m/min and preferably 1 to 5 m/min for operation in the presence of members of the public and 5 to 25 m/min for operation without the presence of members of the public.

Thus, in the case of operations in the presence of members of the public, the movements of the boats are not inconvenient and they are even imperceptible to the pleasure-boat owners. In the case of operation without the presence of members of the public, the speed is higher, increasing the number of entries/exits of boats.

According to one particular characteristic, the secondary elements are floating elements and belong to the group comprising finger pontoons or gangways, adapted to pedestrian access, and floating piers, not adapted to pedestrian access.

The application with the gangways is optimal for pleasure-boat owners who can easily board their boats situated in reception places. The implementation with floating piers is simpler to implement.

According to one particular characteristic, the secondary elements extend appreciably perpendicularly from the central floating element, two successive secondary elements demarcating a longitudinal reception place adapted so that a boat is positioned therein perpendicularly to the central floating element.

In this way, the capacity for putting the boats on hold is further increased.

According to one particular characteristic, the first system of movement is adapted to working according to at least one of the modes belonging to the group comprising:

a first mode in which all the secondary elements are driven at the same time; and a second mode in which at least one of the secondary elements is driven at a first speed while at least one of the secondary elements is not driven or is driven at a second speed distinct from the first speed so as to modify the width of at least one reception place or eliminate one reception place.

The first mode is simpler to implement. The second mode enables adaptation to different uses, in permitting different changes (which may or may not be temporary) in the topology of the reception places around the central floating element, and especially enables a modification of the width of certain places (in modifying the spacing between two successive secondary elements) and/or enables an elimination of certain reception places (in making two successive secondary elements adjoin each other).

According to one particular characteristic, said floating device is adapted so that, during the movement of the secondary floating elements along the closed-looped trajectory around the central floating element, each reception place passes through at least one position of entry/exit facing a position associated with the launching of the boat and/or the hauling of the boat out of the water.

In this way, the length of the movements of the boats between the reception places and/or the launching positions and/or the hauling-out positions is limited.

According to one particular characteristic, the system for putting the boats on hold comprises means for transferring a boat between said at least one entry/exit position and the associated launching and/or hauling-out position.

In this way, the maneuvers for moving the boats between the reception places and/or launching and/or hauling-out positions are automated. This minimizes or even eliminates human action (and therefore the associated risks) during these maneuvers.

According to one particular characteristic, the means of transfer comprise:

two side rails;

one cross-member having at least one mooring device attached to it and possessing two ends each capable of moving along one of the two side rails; and a system for driving the cross-member along the two side rails.

According to one particular characteristic, for a given reception place demarcated by two secondary elements, the two side rails are each fixedly attached to one of the two secondary floating elements.

In this case, the at least one mooring device is fixedly attached to the cross-member which itself moves between the two side rails, which themselves are fixedly attached to two secondary elements. Thus, the driving of these two secondary elements (demarcating a reception place) prompts (via the side rails, the cross-member and the at least one mooring device), the driving of at least one mooring device, and therefore the driving of the boat that may possibly be moored in this reception place.

In one variant, the two side rails are fixedly attached to the central floating element.

In a first implementation of this variant, the system for putting on hold comprises a second system for moving adapted to moving the two side rails around the central floating element.

The second system for moving either coincides with the first system for moving or is distinct from this first system for moving.

In a second implementation of this variant, the system for putting on hold comprises a system of deployment adapted so that the means of transfer successively take the following positions:

a first position, in which the means of transfer are deployed and can fulfill a function of transferring a boat between said at least one entry/exit position and the associated launching or hauling-out position; and a second position, in which the means of transfer are retracted and do not hinder a movement of the secondary elements around the central floating element.

According to one particular characteristic, said at least one mooring device comprises an arm possessing a first end fixed to the cross-member and an electromagnet that is fixed to a second end of the arm and is intended, when it is powered, to attract a metal plate fixed to the boat.

In this way, any boat to which a metal plate is fixed in an appropriate position can automatically be moored and transferred to a reception place and a launching and/or hauling-out position.

According to one particular characteristic, the means of transfer comprise at least one trajectory-maintaining device adapted to artificially creating a current in the sense of a trajectory to be given to the boat.

In this way, the movement of the boat between the reception places and the launching and/or hauling-out position or positions is facilitated.

Another embodiment of the invention proposes a method for putting a boat on hold when afloat on a water body after it has been launched, with a system for putting on hold according to any one of the above-mentioned embodiments. This method comprises the following steps:

the first system for moving moves at least one part of the secondary elements in order to position a vacant reception place in an entry/exit position situated so as to be facing a launching and/or hauling-out position;

after it has been launched, at said launching and/or hauling-out position, the boat is transferred up to the vacant reception place;

then, if necessary, the first system for moving moves at least one part of the secondary elements in order to move the reception place henceforth containing said boat and position another vacant reception place in said entry/exit position to carry out a new launching, or position a reception place containing another boat in said entry/exit position to carry out a hauling-out operation.

Another embodiment of the invention proposes a method for putting on hold a boat afloat on a water body before it is hauled out, with a system for putting on hold according to any one of the above-mentioned embodiments. This method comprises the following steps:

the first system for moving moves at least one part of the secondary elements in order to position a reception place containing the boat in an entry/exit position situated so as to be facing a launching and/or hauling-out position;

the boat is transferred up to the launching and/or hauling-out position in order to be hauled out of the water;

then, if necessary, after the boat has left said reception place, the first system for moving moves at least one part of the secondary elements in order to move the henceforth vacant reception place and position another non-vacant place in said entry/exit position, to carry out a new hauling-out operation for another boat or to position another vacant reception place in said entry/exit position to carry out a launching operation.

4. LIST OF FIGURES

Figure 2A:
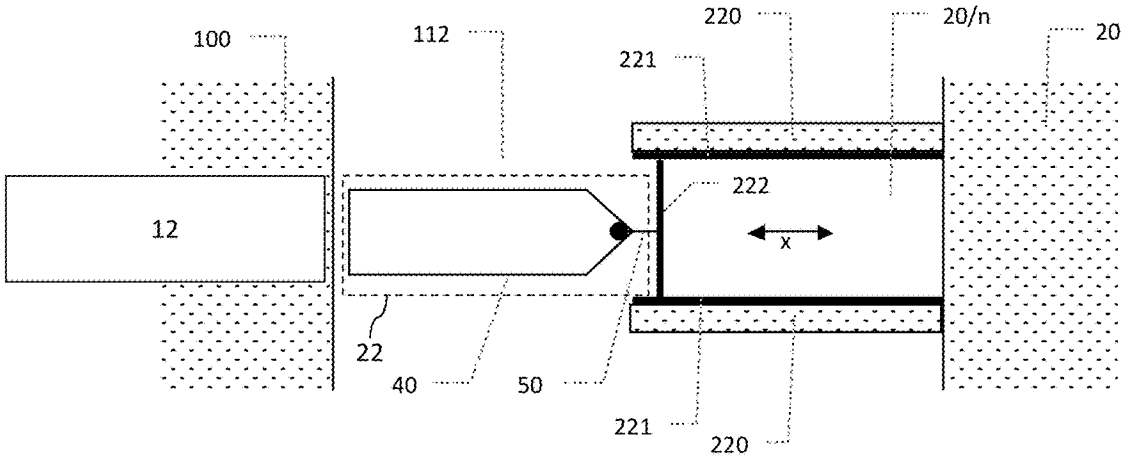
Figure 2B:
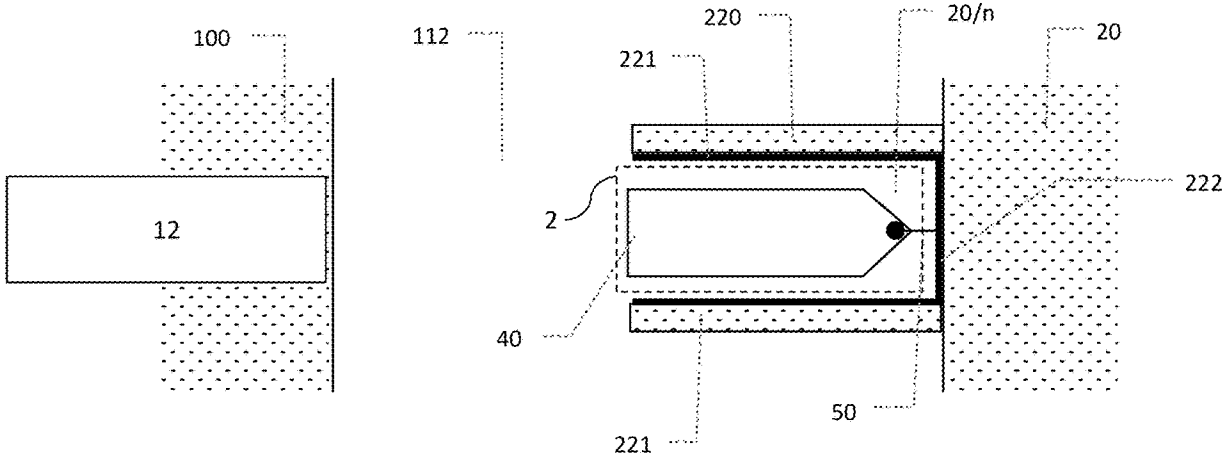
Figure 3:
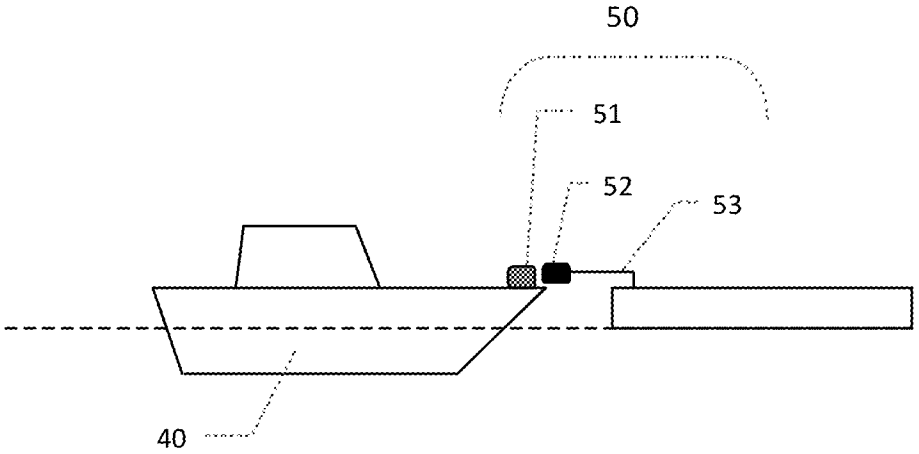

Other features and advantages of the invention shall appear from the following description, given by way of an indicative and non-exhaustive example and from the appended figures, of which:

FIG. 1 presents a top view of a system of putting on hold according to one particular embodiment of the invention;

FIGS. 2*a* and 2*b* illustrate an example of operation of the system for putting on hold of FIG. 1;

FIG. 3 presents a particular implementation of a device for mooring appearing in FIGS. 2*a* and 2*b;*

Figure 4:
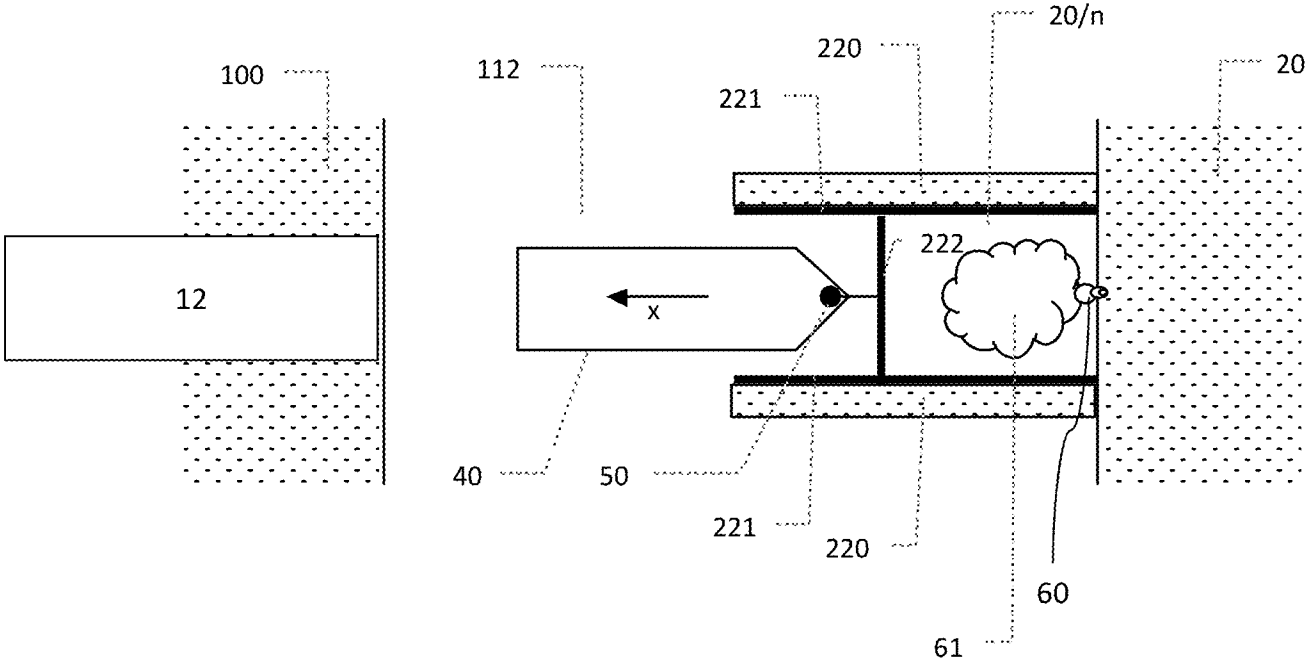
Figure 5A:
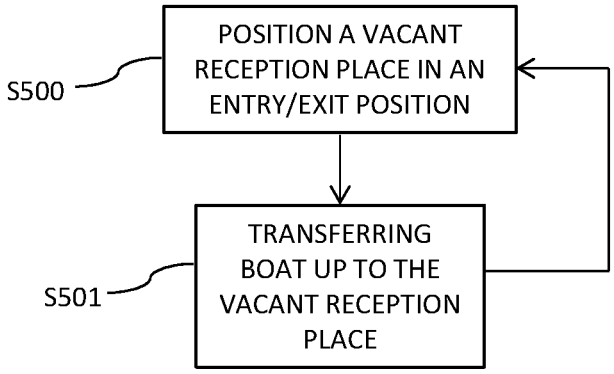
Figure 5B:
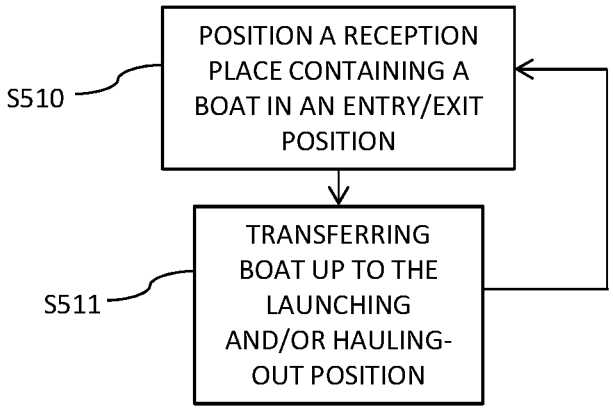

FIG. 4 presents a particular implementation of a device for maintaining a trajectory included in the system for putting on hold, in one alternative embodiment; and FIGS. 5*a* and 5*b* present flowcharts methods for holding a boat according to two embodiments of the disclosure.

5. DETAILED DESCRIPTION

In all the figures of the present document, the identical elements and steps are designated by a same numerical reference.

Referring now to FIG. 1 (seen in a top view), we present a system for putting on hold according to one particular embodiment of the invention.

In this example, it is assumed that the launching as well as the hauling out of the boats 40 are done in two launching/hauling-out stations 12 and 13 (the number of station is given by way of an example, the number of stations for launching is sized on the basis of the maximum flow of boats desired) each situated at a fixed point on a wharf 100, overhanging the water body or on the edge of the water body (for example in the form of a boat launching pad). The launching/hauling-out stations 12 and 13 can be of any nature whatsoever: they may be light means (tugs or trucks) or heavier means (cranes, jib cranes, lift trucks, boat lifts, etc.). The launching/hauling-out stations 12 and 13 can for example be included in a system for the storage of boats on land (dry docks or boat parks) not shown in figure 1.

It is also assumed that each launching/hauling-out station 12 or 13 is associated with a launching/hauling-out position 22 or 23. In the example illustrated, a first boat (shown in solid, unbroken lines) is present in the launching/hauling-out position referenced 22; it has for example just been launched by the launching/hauling-out station referenced 12 and will shortly come to a reception place referenced 20/1 and situated in an entry/exit position referenced 2 (see first boat shown in dashes). Secondly, a second boat (in solid lines) is present in a reception place referenced 20/2 and situated in an entry/exit position referenced 3; it will for example shortly reach the launching/hauling-out position referenced 23 (see second boat shown in dashes) in order to be hauled out by the launching/hauling-out station referenced 13.

In this embodiment, the system for putting on hold comprises:

a floating device 1 (for example a floating pontoon or a floating platform) situated at a distance from the wharf 100 and comprising a central floating element 20 (for example a central pier) and secondary floating elements 220 (for example secondary piers) extending appreciably perpendicularly from the central floating element 20 and demarcating longitudinal reception places 20/1, 20/2, 20/3, etc. (or generically 20/*i*), each adapted so that a boat 40 is placed therein perpendicularly to the central floating element;

a system for moving 21 (for example by cable drive, by a rack-and-pinion system, etc.) adapted to moving all or part of the secondary floating elements 220 around the central floating element (in one particular implementation in a closed-loop trajectory 210 around the central floating element) and therefore all or part of the boats that are positioned in the reception places demarcated by the secondary floating elements;

a passageway 30 (or any other similar structure) connecting the central floating element 20 to the wharf 100 in order to enable access by users whatever the mooring height.

In this embodiment, according to the sense of movement about the central floating element, one of the two secondary floating elements 220 demarcating a reception place drives the boat (contained in this reception place) by thrusts applied at one or more driving points (corresponding to one or more points of contact between the secondary floating element and the boat). In addition or instead, the other of the two secondary floating elements 220 can drive the boat by traction at one or more driving points (corresponding to one or more mooring points (manually or automatically) of the boat with this secondary floating element.

In one variant, a reception place is associated with a single secondary floating element (the one which will make it possible, by thrusts or by traction, to move the boat about the central floating element 20).

In another variant, the system for putting on hold furthermore comprises at least one complementary driving device that comprises at least one driving point, working by thrust or traction, and which too moves about the central floating element (through the above-mentioned system for moving 21 or else another system for moving included in the system for putting on hold). Each complementary driving device comprises for example a mooring element (manual or automatic) fixedly attached to the central floating element and capable of moving about it.

Two floating and secured zones, called channels 112 and 113, each links one of the launching/hauling-out stations 12 and 13 (and therefore one of the associated launching/hauling-out positions 22 and 23) to one of the entry/exit positions 2 and 3 (through each of which pass the reception places 20/1, 20/2, 20/3, etc.).

The floating device 1 is mounted on piles, which are anchored or provided with any other device to prevent drift and to manage tidal fluctuations, this device being adapted to the configuration of the water body, its geology and compliance with the ecosystem.

In one particular implementation, the reception places are sized to receive motorboats having a maximum length of about 8.5 meters and a maximum width of about 3 meters.

The speed of movement of the secondary floating elements 220 (and therefore of the boats 40) is reduced to enable secure maneuvers by the pleasure boat. The system could work in continuous movement mode or in "step by step" mode with a predetermined speed. In one particular implementation, the speed is of the order of 3 m/min (for example ranging from 1 to 5 m/min). In one variant, a first speed is distinguished, for example ranging from 1 to 5 m/min, for an operation in the presence of members of the public and a second speed (for example from 5 to 25 m/min) for operation without a presence of members of the public.

The central floating element 20 can be elliptical or rectangular with rounded corners as drawn in FIG. 1 or it can have any other shape compatible with a closed-loop movement of the boats and also compatible with use by pleasure boats. The central floating element 20 could for example be bone shaped.

In one particular implementation, the secondary floating elements 220 are gangways or finger pontoons (narrow pontoons enabling pedestrian access) laid out perpendicularly to the central floating element 20 in order to demarcate the reception places and to facilitate access to the boats (lateral access). They are, if necessary, equipped with fenders and bow shielding type protection devices in order to protect the boats against the motions of the water and possible impacts.

In one variant, the secondary floating elements 220 are floating piers. In this case, unlike in the gangways, the floating piers do not have pedestrian access.

In another variant, the secondary elements are not floating. These are for example poles or cross-members (extending from the central floating element 20) situated beneath water (and in this case if possible marked out with beacons so as to be visible to the users) or above water.

Depending on the uses, the driving system 21 enables the moving of all or part of the secondary floating elements 220 (and therefore all or part of the moored boats 40).

In a first embodiment, the driving system 21 drives all the secondary floating elements 220 (and therefore all the boats which are positioned therein) at the same time.

In a second embodiment, the driving system 21 selectively drives only certain of the secondary floating elements 220 at a first speed while the others are not driven or are driven at a second speed distinct from the first speed. Thus, it is possible to modify the width of certain reception places or to eliminate certain reception places that attach two successive secondary floating elements together.

The FIGS. 2*a* and 2*b* illustrate an example of operation of the system for putting on hold of FIG. 1, and FIGS. 5*a* and 5*b* illustrate associated acts.

Principle of a Launch Followed by an Operation for Putting on Hold

In anticipation of a launch, upon manual activation or entirely automated activation, the system for moving 21 moves all or part of the secondary floating elements 220 and therefore all or part of the reception places and boats that are positioned therein in order to position a vacant place (referenced 20/*n* in the example considered) in one of the entry/exit positions (referenced 2 in the example considered) facing one of the launching/hauling-out stations (referenced 12 in the example considered) and therefore facing one of the launching/hauling-out positions (referenced 22 in the example considered) in an act S500.

The launching/hauling-out station 12 carries out the launching of the boat 40, and then positions it in the launching/hauling-out position 22 which faces the channel referenced 112 as illustrated in FIG. 1.

Then, the boat is automatically moored and transferred to the floating device 1 (or more specifically the vacant reception place 20/*n* in the example considered) in an act 5501, in order to be put on hold therein (until a pleasure-boat owner retrieves it) as illustrated in FIG. 2*b*. The principles of mooring and of transfer are described in the following paragraphs.

Once the boat has been moored and transferred, the system for moving 21 can be activated in order to move the boat and, depending on need, either bring a new vacant place to face the launching/hauling-out station 12 in another act S500 in order to carry out a new launch or bring a place containing another boat to face the launching/hauling-out station 12 in an act S510 with the prospect of a hauling out of this other boat.

Principle of Putting on Hold Followed by a Hauling Out

It is assumed that a pleasure-boat owner has placed and moored a boat 40 in one of the reception places (referenced 20/*n* in the example considered).

In anticipation of a hauling-out operation, upon manual activation or entirely automated activation, the system for moving 21 moves all or part of the secondary floating elements 220 and therefore all or part of the reception places and boats that are positioned therein in order to position the above-mentioned boat (and therefore the reception place 20/*n*) in one of the entry/exit positions (referenced 2 in the example considered) facing one of the launching/hauling-out stations (referenced 12 in the example considered) and therefore facing one of the launching/hauling-out positions (referenced 22 in the example considered) in an act S510.

The boat is automatically unmoored and transferred up to the launching/hauling-out position 22 in an act S511.

The launching/hauling-out station 12 hauls the boat out of the water.

As soon as the boat has left the reception place 20/*n*, the system for moving 21 can, if necessary, be activated for example to bring a new boat into the entry/exit position 2 in another act S510 with the prospect of another hauling-out operation, or else to position a vacant reception place in the entry/exit position 2 in an act S500, in order to carry out a launch. Another possibility is to use the reception place 20/*n*, which is now unoccupied, to carry out a launching operation.

Means for Transferring the Boat

These means for transferring enable the transfer of a boat from one of the launching positions 22 and 23 to the floating device 1 (and more precisely to one of the entry/exit positions 2 and 3 successively occupied by each of the reception places 20/*n*) or vice versa.

In one particular implementation, said means for transferring comprise the following (see FIGS. 2*a* and 2*b*) for a given reception place demarcated by two secondary floating elements (gangways, floating piers) 220:

- two side rails 221 each fixedly attached to one of the two secondary floating elements 220;
- a cross-member 222*a* that is fixedly attached to an mooring device 50 (see FIG. 3) and possesses two ends each capable of moving along one of the two side rails 221 along the axis x;
- a system (not shown) for driving the cross-member 222 along the side rails 221; and
- a device 50 for mooring the boat 40 to the cross-member 222.

The moving of the cross-member 222 thus enables the boat to be moved towards the floating device 1 (when it is put on hold after being launched) or towards the wharf 100 when the boat is placed on hold before being hauled out of the water.

In one alternative embodiment, the two side rails 221 are not fixedly attached to one of the secondary floating elements 220 but are fixedly attached to the central floating element 20. Two implementations of this variant are proposed:

- either the above-mentioned system for moving 21 (or else another system for moving included in the system for putting on hold) is adapted to moving the two side rails 221 about the central floating element 20 (movement of the secondary systems about the central floating element),
- or the system for putting into contact includes a system of deployment, adapted so that the means of transfer can successively take the following positions:
  - a first position, in which the means for transferring are deployed (as illustrated in FIGS. 2*a* and 2*b*) and can fulfill a function of transfer of a boat between said at least one entry/exit position and the associated launching/hauling-out position; and
  - a second position, in which the means for transferring are retracted (they are for example brought above the central floating element 20) and do not hinder any movement of the secondary elements around the central floating element.

FIG. 3 presents a particular and non-exhaustive implementation of the mooring device 50 appearing in FIGS. 2*a* and 2*b*.

The automatic mooring of the boat is provided by an electromagnetic system comprising:

- a metal plate 51 fixed to the front of the boat 40; and
- an electromagnet 52 mounted at the end of an arm (rod) 53 itself fixed to the cross-member 222.

When the electromagnet 52 is powered and placed in proximity to the plate 51, the plate is attracted by the electromagnet thus providing for the mooring of the boat. Conversely, when the electromagnet is no longer powered, the mooring point is eliminated.

FIG. 4 presents a particular implementation of a trajectory-maintaining device included in the system for putting on hold in one alternative embodiment.

In order to facilitate the translation of the boat and maintain its trajectory, during the transfer from one of the entry/exit positions 2 and 3 to one of the launching/hauling-out positions 22 and 23 (or vice versa), the system comprises at least one device for maintaining trajectory 60. This device enables the artificial creation of a current in the sense of a trajectory to be conveyed to the boat (axis x, from right to left in the example of FIG. 4).

The trajectory-maintaining device 60 comprises for example one or more apparatuses of the pumping system type or pressurizing system type connected to nozzles, fans or the like enabling the shifting of a mass of water or air 61 and also thereby enabling the desired trajectory to be conveyed to the boat. These nozzle, fan or similar type apparatuses make it possible to convey the desired trajectory to the boat. These apparatuses which are of the nozzle, fan or other similar types 60 are if necessary placed at different points of the trajectory.

An exemplary embodiment of the present disclosure provides a technique for putting boats on hold when afloat on a water body (after they have been launched and/or before they have been hauled out of water), increasing the capacity for putting boats on hold without restricting the possibilities of access to the water body (for example without increasing the occupancy of the seafront in the case of a maritime water body).

An exemplary embodiment provides such a technique making it possible to minimize or even eliminate human action during operations for moving the boat to or from the holding area.

An exemplary embodiment provides a technique of this kind that can be used to secure boats during maneuvers for moving the boat to or from the holding area, as well as during periods when the boat is afloat.

An exemplary embodiment provides a technique of this kind that is compatible with the use of a system for storing boats on land (dry docks or boat parks) with a high density (i.e. with low consumption of surface area for a large number of boats stored) with secured access, whatever the type of handling means used: light means (tugs or trucks) or heavier means (cranes, jib cranes, lift trucks, boat lifts, etc.).

Although the present disclosure has been described with reference to one or more examples, workers skilled in the art will recognize that changes may be made in form and detail without departing from the scope of the disclosure and/or the appended claims.

The invention claimed is:

1. A system for holding boats when the boats are afloat on a water body after the boats have been launched and/or before the boats are hauled out of the water, said system comprising:

a floating device, comprising:

a central floating element;

a plurality of secondary elements extending longitudinally from the central floating element, a plurality of reception places demarcated along the central floating element by the plurality of secondary elements, wherein each reception place is demarcated by at least one of the secondary elements to receive and contain a boat, wherein at least one of the secondary elements that demarcate each reception place comprises at least one driving point corresponding to a point of contact between the secondary element and a boat positioned in said boat reception place or a mooring point, at which the secondary element drives by thrust or traction the boat positioned in said boat reception place; and a driving system, which moves the secondary elements around the central floating element and moves, via the at least one driving point, boats that are positioned in the respective boat reception places.

2. The system for holding boats according to claim 1, wherein the driving system comprises a closed-loop trajectory around the central floating element, and the driving system moves the secondary elements along the closed-loop trajectory.

3. The system for holding boats according to claim 1, comprising at least one passageway connecting the central floating element to a wharf or to an edge of the water body.

4. The system for holding boats according to claim 1, wherein the driving system moves the secondary elements at a speed of 1 to 25 m/min.

5. The system for holding boats according to claim 1, wherein the secondary elements comprise floating elements and belong to the group consisting of gangways and floating piers.

6. The system for holding boats according to claim 1, wherein the secondary elements extend perpendicularly from the central floating element, two successive secondary elements demarcating a respective one of the boat reception places, which is arranged so that a boat positioned therein is oriented perpendicularly to the central floating element.

7. The system for holding boats according to claim 1, wherein the driving system comprises one of the modes belonging to the group consisting of:

a first mode in which all the secondary elements are driven at the same time; and a second mode in which at least one of the secondary elements is driven at a first speed while at least one of the other secondary elements is not driven or is driven at a second speed distinct from the first speed so as to modify a width of at least one of the boat reception places or eliminate one of the boat reception places.

8. The system for holding boats according to claim 2, wherein said floating device is arranged so that, during the movement of the secondary floating elements along the closed-looped trajectory around the central floating element, each boat reception place passes through at least one position of entry/exit facing a station associated with the launching of the boat and/or the hauling of the boat out of the water.

9. The system for holding boats according to claim 8, comprising a transfer device, which transfers a boat between said at least one entry/exit position and the associated launching and/or hauling-out station.

10. The system for holding boats according to claim 9, wherein the transfer device comprises:

first and second side rails;

a cross-member having at least one mooring device and possessing two ends each being movable along one of first or second side rails; and a driving system, which drives the cross-member along the two side rails.

11. The system for holding boats according to claim 10, wherein for a given one of the boat reception places demarcated by two of the secondary elements, the first and second side rails are each fixedly attached to one of the two secondary floating elements.

12. The system for holding boats according to claim 10, wherein the first and second side rails are fixedly attached to the central floating element.

13. The system for holding boats according to claim 12, comprising a second system, which moves the first and second side rails around the central floating element.

14. The system for holding boats according to claim 10, wherein said at least one mooring device comprises an arm possessing a first end fixed to the cross-member and an electromagnet that is fixed to a second end of the arm and when powered attracts a metal plate fixed to the boat.

15. The system for holding boats according to claim 9, wherein the transfer device comprises at least one fan or at least one pumping or pressurizing system connected to a nozzle, wherein the fan or the nozzle is placed to artificially create a current in a direction of a trajectory to be given to the boat.

16. A method comprising:

holding a boat when afloat on a water body after the boat has been launched, with a system comprising:

a floating device, comprising a central floating element and a plurality of secondary elements extending longitudinally from the central floating element, a plurality of boat reception places demarcated along the central floating element by the plurality of secondary elements, wherein each boat reception place is demarcated by at least one of the secondary elements to receive and contain a boat, and wherein at least one of the secondary elements that demarcate each reception place comprises at least one driving point corresponding to a point of contact between the secondary element and a boat positioned in said boat reception place or a mooring point, at which the secondary element drives, by thrust or traction, the boat positioned in said boat reception place; and a first driving system, which moves the secondary elements around the central floating element and moves, via the at least one driving point, the boats that are positioned in the boat reception places;

wherein holding a boat comprises:

the driving system moving at least one part of the secondary elements in order to position a vacant one of the boat reception places in an entry/exit position on the central floating element, facing a launching and/or hauling-out station;

after a first boat has been launched, at said launching and/or hauling-out station, transferring the first boat into the vacant boat reception place, the vacant boat reception place thereby becoming an occupied boat reception place; and then, the driving system moving at least one part of the secondary elements in order to move the occupied boat reception place containing said first boat and to position another vacant one of the boat reception places in said entry/exit position to carry out a new launching, or to position another, occupied one of the boat reception places containing another, second boat in said entry/exit position to carry out a hauling-out operation.

17. A method comprising:

holding a boat afloat on a water body before the boat is hauled out, with a system comprising:

a floating device, comprising a central floating element and a plurality of secondary elements extending longitudinally from the central floating element, a plurality of boat reception places demarcated along the central floating element by the plurality of secondary elements, wherein each boat reception place is demarcated by at least one of the secondary elements to receive and contain a boat, and wherein at least one of the secondary elements that demarcate each reception place comprises at least one driving point corresponding to a point of contact between the secondary element and a boat positioned in said boat reception place or a mooring point, at which the secondary element drives, by thrust or traction, the boat positioned in said boat reception place; and a driving system, which moves the secondary elements around the central floating element and moves, via the at least one driving point, the boats that are positioned in the boat reception places;

wherein holding the boat comprises:

the driving system moving at least one part of the secondary elements in order to position an occupied one of the boat reception places, which contains a first boat, in an entry/exit position on the central floating element and situated so as to be facing a launching and/or hauling-out station;

transferring the first boat to the launching and/or hauling-out station in order to be hauled out of the water; and then, after the first boat has left said occupied boat reception place, which thereby becomes a vacant boat reception place, the driving system moves at least one part of the secondary elements in order to move the vacant boat reception place and to position another occupied one of the boat reception places in said entry/exit position, to carry out a new hauling-out operation for another, second boat or to position another vacant one of the boat reception places in said entry/exit position to carry out a launching operation.

* * * * *